United States Patent [19]

Suzuki et al.

[11] Patent Number: 4,867,087

[45] Date of Patent: Sep. 19, 1989

[54] SEWING MACHINE FOR PERFORMING PATTERN-MATCH SEWING

[75] Inventors: Shigeru Suzuki, Nagoya; Etsuzo Nomura, Kasugai; Hirokazu Takeuchi, Nagoya, all of

[73] Assignee: Brother Kogyo Kabushiki Kaisha, Aichi, Japan

[21] Appl. No.: 190,103

[22] Filed: May 4, 1988

[30] Foreign Application Priority Data

May 11, 1987 [JP] Japan ..... 62-113994

[51] Int. Cl.[4] ..... D05B 27/06; D05B 27/08

[52] U.S. Cl. ..... 112/314; 112/121.11; 112/320

[58] Field of Search ..... 112/306, 314, 312, 315, 112/320, 121.11, 272, 153

[56] References Cited

U.S. PATENT DOCUMENTS 4,612,867 9/1986 Rösch et al. ..... 112/314
4,766,828 8/1988 Nomura ..... 112/314
4,777,896 10/1988 Nomura ..... 112/121.11 X

FOREIGN PATENT DOCUMENTS 2197349 5/1988 United Kingdom .

*Primary Examiner*—Peter Nerbun
*Attorney, Agent, or Firm*—Oliff & Berridge

[57] ABSTRACT

A sewing machine for sewing two overlapped cloth pieces including sensor means for detecting the intensity of light transmitted through each respective cloth piece, intensity curve generating means for generating respective intensity curves over a predetermined distance, differentiation means for differentiating between the intensity curves of each cloth piece and for generating differential curves for each cloth piece, difference determining means for determining a displacement between the two differential curves and feed pitch control means for adjusting a feed pitch based on the displacement. The sewing machine of the invention matches and sews the two cloth pieces having the same lateral and vertical patterns by ignoring the detected vertical pattern data having unclear and vague broad peaks and using the detected lateral pattern data having clear sharp peaks to have the two cloth pieces' patterns matched in alignment.

11 Claims. 18 Drawing Sheets

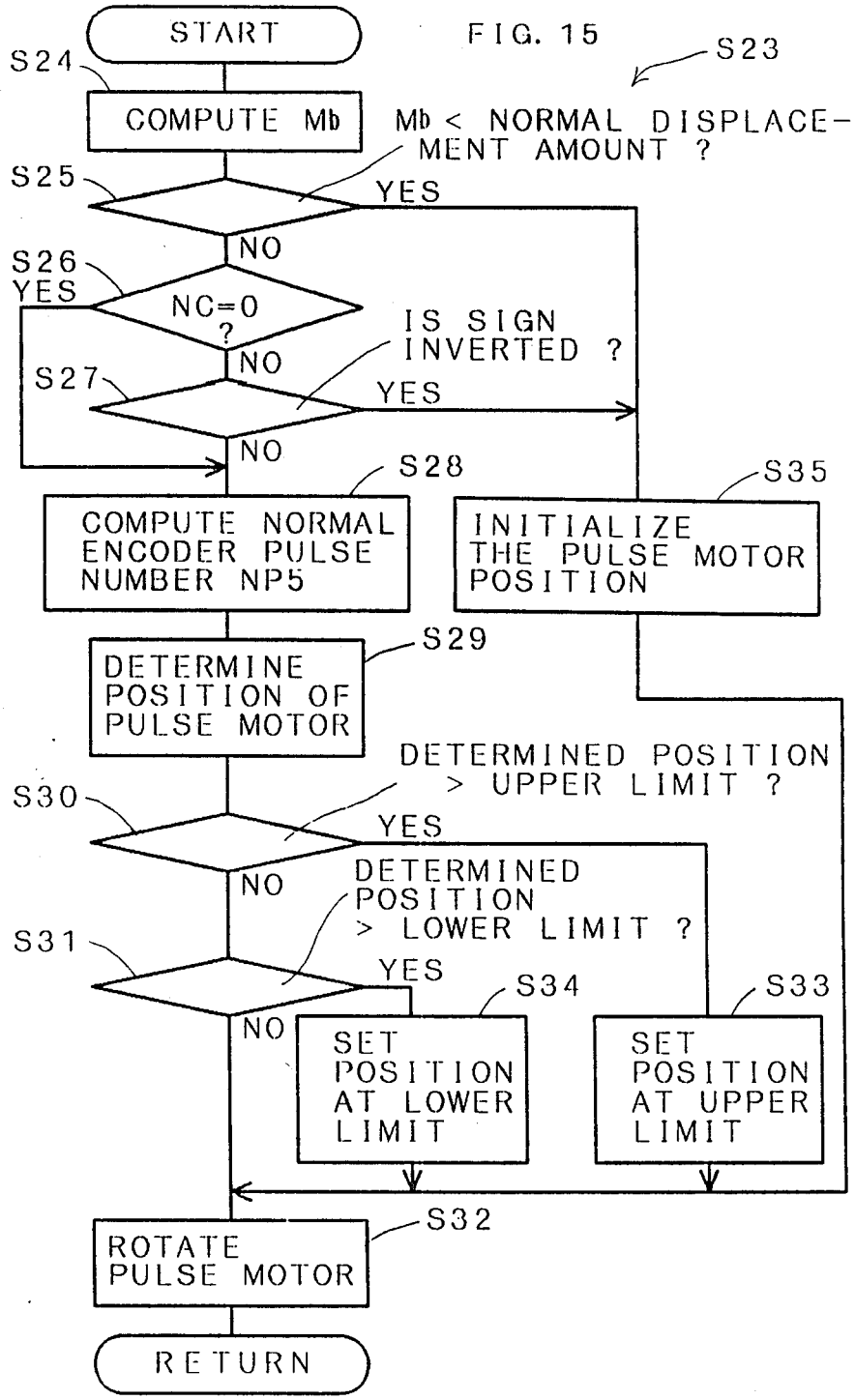
START
FIG. 15
S24
COMPUTE Mb
S23
Mb < NORMAL DISPLACE-MENT AMOUNT ?
S25
YES
NO
S26
YES
NC=0 ?
NO
IS SIGN INVERTED ?
S27
YES
NO
S28
COMPUTE NORMAL ENCODER PULSE NUMBER NP5
S35
INITIALIZE THE PULSE MOTOR POSITION
S29
DETERMINE POSITION OF PULSE MOTOR
DETERMINED POSITION > UPPER LIMIT ?
S30
YES
NO
DETERMINED POSITION > LOWER LIMIT ?
S31
YES
NO
S34
SET POSITION AT LOWER LIMIT
S33
SET POSITION AT UPPER LIMIT
S32
ROTATE PULSE MOTOR
RETURN

SEWING MACHINE FOR PERFORMING PATTERN-MATCH SEWING

BACKGROUND OF THE INVENTION

This invention relates to a sewing machine which sews upper and lower cloth pieces having the same pattern on the two cloth pieces while maintaining correct alignment of the pattern.

Generally, in a conventional sewing machine, a skilled working must spend many hours and take great care in sewing together two cloth pieces having the same pattern to form the back body of a blazer for either a gentleman or a lady or to fasten the parts of sleeves to the shoulders of the blazer body while maintaining correct alignment of the pattern.

U.S. Pat. No. 4,612,867 discloses a sewing machine for performing pattern-match sewing. The sewing machine has two sensors one for the upper cloth and another for the lower cloth, detects intensity of light from each cloth with the sensors and generates intensity curves for each cloth. The sewing machine determines displacement between the two cloth by comparing the intensity curves and adjusts a feed pitch of the upper cloth in order to align patterns of the cloth pieces based on the displacement.

The upper and lower cloth pieces each having both a lateral pattern and a vertical pattern thereon, e.g. having a check pattern, are sewed on the bias against the patterns as shown in FIG. 22. In this case, an end of the lateral pattern passes over a detector much faster than that of the vertical pattern. FIG. 23A shows detected data corresponding to the vertical pattern and its data curve has broad peaks. FIG. 23B shows data detected, on the other hand, corresponding to the lateral pattern and its data curve has sharp peaks. The pattern matching of the two cloth pieces is usually conducted by either matching the vertical or lateral pattern on the two pieces in alignment. When the vertical pattern, however, is used for the pattern matching, there is some difficulty because of its unclear and vague broad peaks.

SUMMARY OF THE INVENTION

This invention has been made in order to overcome the above disadvantages.

It is an object of this invention to provide a sewing machine which is capable of easily and steadily sewing two upper and lower cloth pieces having the same pattern to each other in aligned positions, and requires no skill to perform the sewing operation and is inexpensively manufactured.

Another object of the invention is to provide a sewing machine which, when two cloth pieces having both the lateral and vertical patterns are sewn on the bias, ingnores pattern data with unclear and vague broad peaks, e.g., vertical pattern, but uses pattern data with clear sharp peaks, e.g., lateral patterns, to have the pattern matching correctly.

In order to achieve the above and other related objects, a sewing machine of the invention includes: stitch forming means including a needle movable up and down through a cloth support surface for sewing two overlapped cloth pieces, said two cloth pieces having the same pattern; upper feeding means arranged over said cloth support surface for feeding the upper one of the two cloth pieces, said upper feeding means being actuated synchronously with said stitch forming means; lower feeding means arranged under said cloth support surface for feeding the lower one of the two cloth pieces, said lower feeding means being actuated synchronously with said stitch forming means; sensor means for detecting intensity of light from each of the cloth pieces and for generating intensity signals; memory means for storing intensity signals; intensity curves generating means for generating intensity curves extending over a predetermined distance for each cloth pieces based on intensity signals in said memory means; differentiating means for differentiating the intensity curves and for generating differential curves of patterns of said clotch pieces; difference determining means for determining a displacement between the differential curves; and feed pitch control means for adjusting a feed pitch of at least one of said upper and lower feeding means in order to align the patterns of said clotch pieces based on the displacement.

BRIEF DESCRIPTION OF THE DRAWINGS

FIG. 15 is a flowchart showing the subroutine of step 23 of FIG. 13;

DETAILED DESCRIPTION OF THE EMBODIMENT

Now, an embodiment of this invention will be described in detail with reference to the attached drawings.

(Stitch Forming Device)

Figure 1:
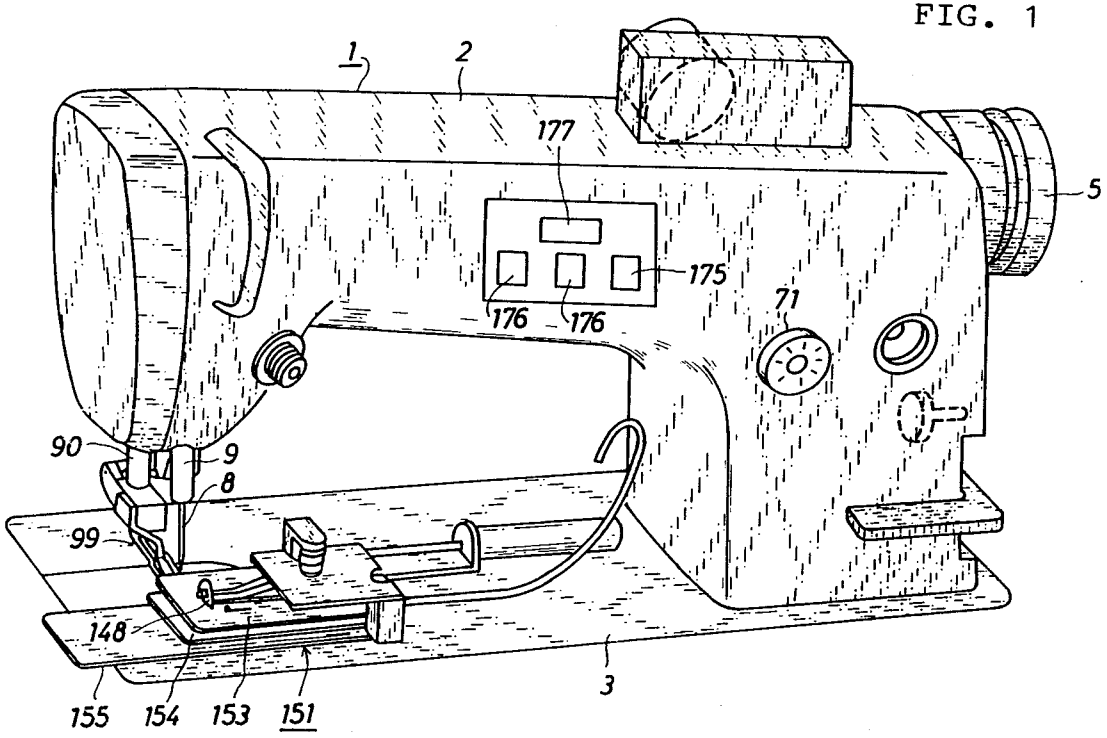
FIG. 1 is a perspective view showing a whole sewing machine frame of an embodiment of the invention.
Figure 3:
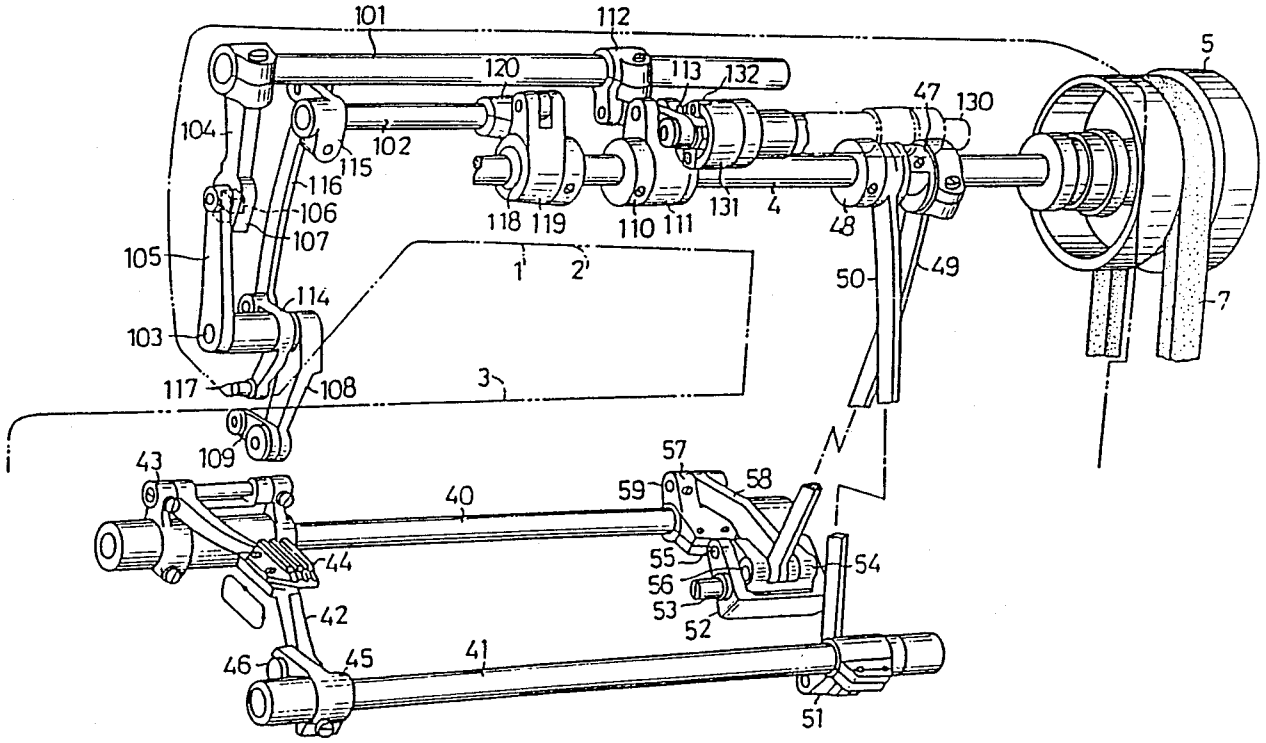
FIG. 3 is a perspective view showing the internal structure of the sewing machine.
Figure 11:
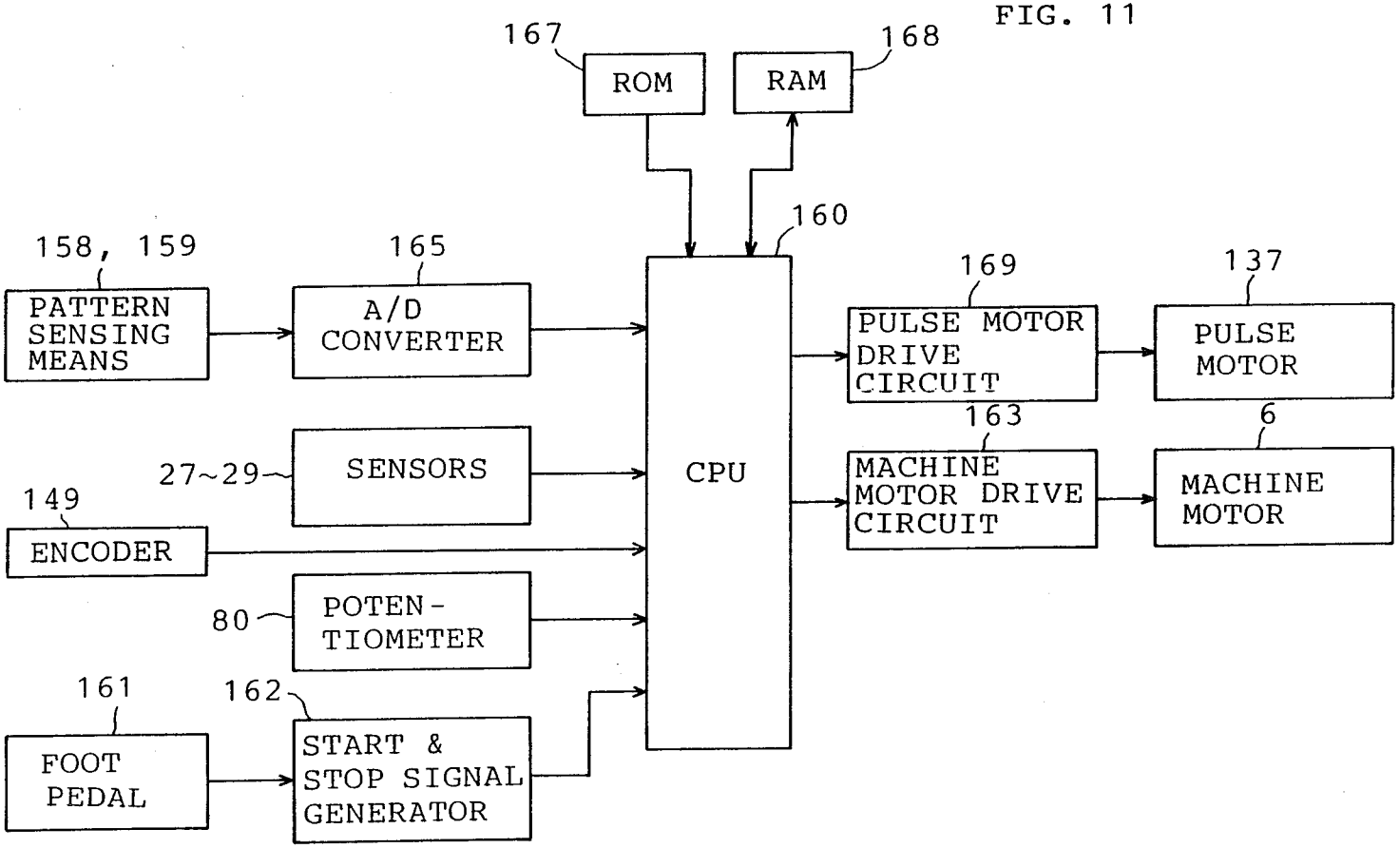
FIG. 11 is a block diagram showing the electrical structure of the sewing machine.

As shown in FIG. 1, a machine frame 1 includes an arm portion 2 and a bed portion 3. As shown in FIG. 3 the arm portion 2 supports a main machine shaft 4 rotatably which mounts a driven pulley 5 at its right end. The torque of a machine motor 6, shown in FIG. 11, is transmitted via a belt 7 and the pulley 5, as shown in FIG. 3, to the shaft 4 to rotate it.

As shown in FIG. 4, the arm portion 2, shown in FIG. 1, supports a needle bar 9 having a needle 8 at its lower end, so that the needle rod can move up and down. When the main shaft 4 is rotated, the needle 8 is moved up and down through a cloth support surface 10 of the bed portion 3. A loop taker 11 is supported in bed portion 3 so that it can rotate around a horizontal axis and catches needle thread (not shown) carried by the needle 8 to form a thread loop. The thread loop is formed by rotation of the loop thread 11 synchronously with up-and-down movement of the needle 8. The loop causes the loop taker 11 to supply lower thread which then cooperates with the loop to form a stitch in two cloth pieces 12*a*, 12*b* on the cloth support surface 10.

The stitch forming device includes the needle 8 and the loop taker 11.

Figure 5C:
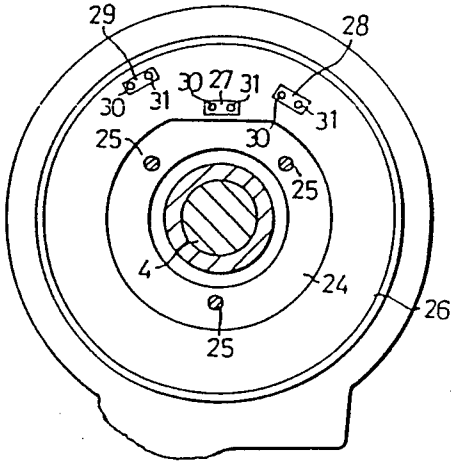
FIG. 5C is likewise a cross-sectional view taken along the line 5—5 of FIG. 3.
Figure 5B:
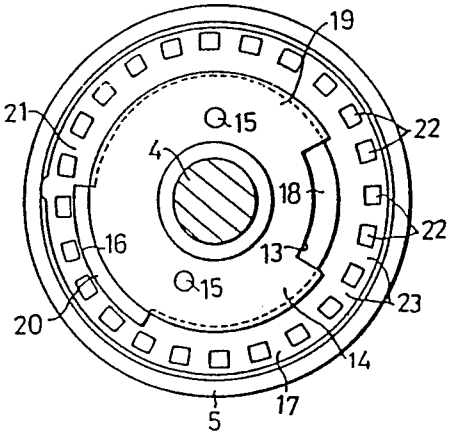
FIG. 5B is a cross-sectional view taken along the line 4—4 of FIG. 3.
Figure 5A:
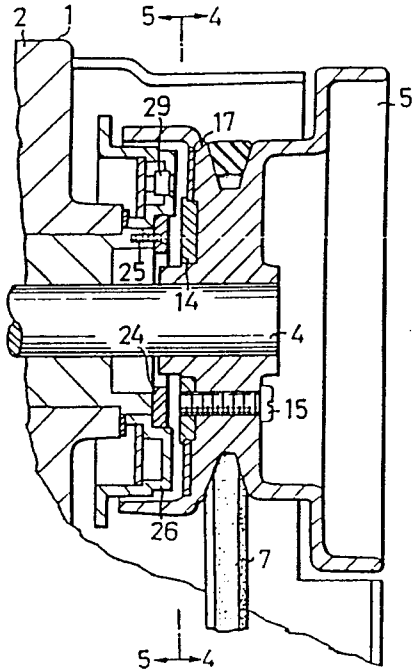
FIG. 5A is a partially enlarged cross-sectional view of a sensor for sensing the position of a sewing machine needle and the rotating angle of the main machine shaft.

As shown in FIGS. 5A–5C, a first reflective plate 14 having an arcuate cut 13 along its outer periphery is attached by two screws 15 to the left side of the pulley 5. Attached between the outer periphery of the first reflective plate 14 and the side of the pulley 5 is a second ring-like reflective plate 17 having a cut 16 along its inner periphery. The respective cuts 13 and 16 of the plates 14 and 17 are disposed at a spacing of about 180 degrees. The area defined by the cut 13 and the inner periphery of the second reflective plate 17 constitutes a non-reflective surface 18 for sensing the upper-position of the needle while the surface of the first reflective plate 14 positioned concentric with the non-reflective surface 18 constitutes a reflective surface 19. On the other hand, the cut 16 in the second reflective plate 17 and the outer periphery of the first reflective plate 14 defines an area which constitutes a non-reflective surface 20 for sensing the lower position of the needle 8. The surface of the second reflective plate 17 positioned concentric with the non-reflective surface 20 constitutes a reflective surface 21. The surface of the second reflective plate 17 has non-reflective surfaces 22 and reflective surfaces 23 disposed alternately at predetermined angular spacings outwardly of the cut 16.

A support body 26 is mounted by three screws 25 through a mounting plate 24 within the arm portion 2 so as to be situated outwardly of the main shaft 4 in proximity to the respective plates 14, 17. Sensors 27, 28 and 29 are mounted on the support body 26 opposed to the non-reflective surfaces 18, 20, 22 and sense the upper position of the needle 8, the lower position of the needle 8 and a rotating angle, respectively. Each of sensors 27–29 includes a light emitting element 30 and a light receiving element 31. When the pulley 5 is rotated, the light emitted from the light emitting element 30 is reflected by the reflective surfaces 19, 21 and 23 and absorbed by the non-reflective surfaces 18, 20 and 22. If no reflected light enters the respective light receiving element 31, the respective sensors 27–29 output a needle upper-position sensing signal, a needle lower-position sensing signal and a synchronous signal (see FIG. 12), while when the reflected light is entered, no such signals are output.

(Lower Feeding Device)

Next, a lower feeding device which is engaged with the lower surface of the lower one of the two clotch pieces 12*a*, 12*b* to apply a feed to the lower cloth piece 12*b*, will be described. As shown in FIG. 3, rotatably supported within the bed 3 of the machine frame 1 are a horizontal-feed shaft 40 and a vertical-feed shaft 41, both of which extend horizontally. A feed bar 42 is rotatably supported at the left end of the horizontal-feed shaft 40 by means of a support arm 43. On the bar 42 is attached a lower-feed dog 44 which can appear above the cloth support surface 10 of the bed 3. Attached to the left end of the vertical-feed shaft 41 is an engagement arm 45 having a bifurcate end which is engaged with a forward engagement end 46 of the feed bar 42. As the main shaft 4 is rotated, the horizontal-feed shaft 40 and the vertical-feed shaft 41 perform a reciprocal movement, so that the lower-feed dog 44 is caused to perform a four-motion feed, thereby applying a feed to the lower cloth piece 12*b* on the support surface 10.

In more detail, as shown in FIG. 3, mounted on the main shaft 4 are the horizontal- and vertical-feed eccentric cams 47, 48 on which crank rods 49, 50 are mounted at their upper ends in an embracing manner. The vertical-feed crank rod 50 is coupled at its lower end via a coupling arm 51 to the vertical-feed shaft 41. As the vertical-feed eccentric cam 48 is rotated, the vertical-feed shaft 41 is caused to perform a reciprocating turn by means of the crank rod 50 within a predetermined range.

Figure 7:
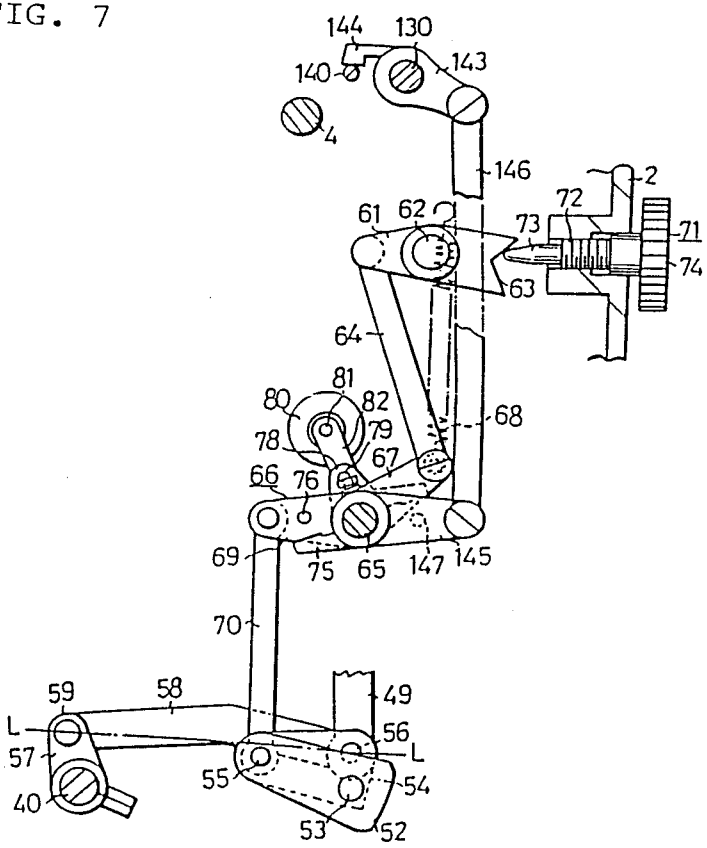
FIG. 7 is a side cross-sectional view of the device and sensor of FIG. 6.

On the other hand, as shown in FIGS. 3 and 7, a substantially U-like feed regulator 52, corresponding to the lower end of the horizontal-feed crank rod 49, is rotatably supported by a support shaft 53 within the bed 3. A horizontal-feed link 54 is rotatably supported at its backward end by a support pin 55 to a backward end of the feed changer 52. The horizontal-feed crank rod 49 is rotatably coupled at its lower end to a support shaft 56 disposed inside the horizontal-feed link 54. A link 58 is rotatably coupled at its backward end to the horizontal-feed shaft 40 by means of a coupling arm 57 and a coupling shaft 59 so that it is opposed to the support shaft 56. The link 58 is rotatably coupled at its tip end to the support shaft 56. When the horizontal-shaft eccentric cam 47 is rotated by rotational adjustment of the feed regulator 52 around the support shaft 53 in the sate of the support shaft 55 being set to a predetermined position, the horizontal-feed link 54 is caused to perform a reciprocating turn around the support shaft 55 via the crank rod 49. Thus, a rotational torque in the back and forth direction is applied via the link 58 to the coupling arm 57 in accordance with the position where the support shaft 55 is set, so that the horizontal-feed shaft 40 is caused to perofrm a reciprocating turn within a predetermined range.

The lower-feed device includes the eccentric cams 47, 48, the crank rods 49, 50, the horizontal-feed link 54, the link 58, the horizontal-feed shaft 40, the vertical-feed shaft 41, the feed bar 42 and the lower-feed dog 44.

(Lower-Feed Adjustment Device and Feed Sensing Device)

The lower-feed adjustment device which adjusts the turn of the feed regulator 52 to change and set the feed pitch and feed direction of the lower cloth piece 12*b* by the lower-feed dog 44, will be described.

Figure 6:
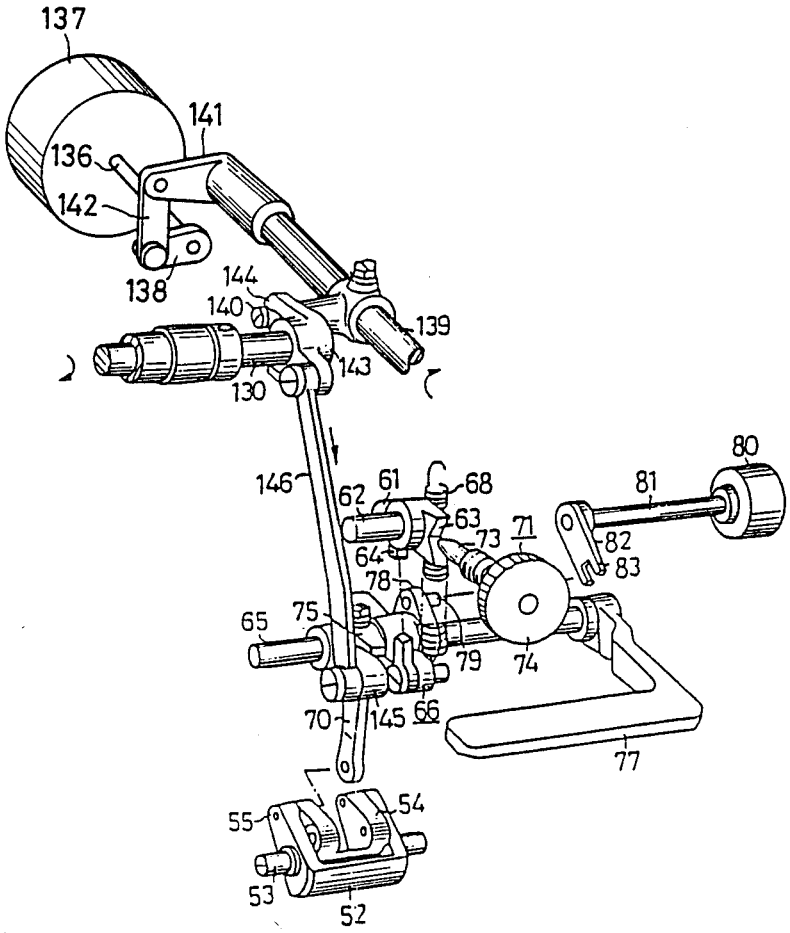
FIG. 6 is a partial perspective view showing the feed adjusting device and feed sensor.

As shown in FIGS. 6 and 7, a feed adjustment member 61 is rotatably supported substantially at its center by a support shaft 62 within the arm portion 2 of the machine frame 1. The adjustment member 61 has a V-like feed control cam 63 at its forward end. A coupling rod 64 having the lower end extending downward is rotatably connected at its upper end to the backward end of the feed adjustment member 61. A horizontally extending operating shaft 65 is rotatably supported within the arm portion 2 in the vicinity of the lower end of the coupling rod 64. A three-arm-like engagement member 66 is fitted at its middle portion over the operating shaft 65 so as to permit relative rotation. The coupling rod 64 rotatably coupled at its lower end to a first arm 67 of the engagement lever 66. The engagement lever 66 is biased by a spring 68 engaged with the first arm 67 so as to rotate counterclockwise as viewed in FIG. 7. A second arm 69 of the engagement lever 66 is coupled via the coupling rod 70 to the support pin 55.

The feed adjustment member 61 is biased clockwise in FIG. 7 by the action of the spring 68 and normally disposed at a predetermined position shown in FIG. 7. On the other hand, when the feed adjustment member 61 is turned counterclockwise in FIG. 7 against the action of the spring 68, the feed regulator 52 is turned clockwise via the coupling rod 64, the lever 66 and the coupling rod 70. At this time, when the axis of the support pin 55 approaches the straight line L—L connecting the support shaft 56 and the coupling shaft 59, the cloth feed pitch is reduced. When the axis of the support pin 55 is moved upward beyond the straight line L—L, the direction of cloth feed is reversed.

As shown in FIGS. 6 and 7, a manually operated member 71 is rotatably screwed at its middle threaded portion 72 into the arm portion 2 of the machine frame 1. A shaft 73 is provided at the inner end of the feed adjustment member 61 so as to engage with a feed control cam 63 of the feed adjustment member 61 to hold the member 61 at a predetermined position against the action of the spring 68. A large-diameter operated member 74 is provided at the outer end of the manually operated member 71.

When the operated portion 74 of the manually operated member 71 is manually turned to move the member 71 back and forth, the tilt angle of the feed adjustment member 61 is altered via the engaged shaft 73 and the feed control cam 63, and the clotch feed pitch is thereby changed, as described above.

An operating lever 75 is securely fixed to the middle portion of the operating shaft 65 in the vicinity of the engagement lever 66 so as to turn integrally with the operating shaft 65. The rear end of the lever 75 is opposed to the lower portion of an engagement pin 76 protruding from the left side of the second arm portion 69 of the engagement lever 66. An operated lever 77 is attached to the right end of the operating shaft 65 outside the arm portion 2 of the machine frame 1. When the operated lever 77 is pressed down to rotate the shaft 65 and the lever 75 clockwise in FIG. 8, the lever 75 is engaged with the engagement pin 76, so that the feed regulator 52 is turned via the coupling rod 70 to a feed reversing position, thereby reversing the cloth feed direction.

Protruding from a third arm portion 78 of the engagement lever 66 is a coupling pin 79 which is opposed to a feed sensor including a potentiometer 80 disposed on the frame arm portion 2 of the machine frame 1. A coupling lever 82 is securedly fixed at its base end to a tip end of a turning shaft 81 of the potentiometer 80. A bifurcate portion 83 formed at a tip end of the lever 82 is engaged with the engagement pin 79. When the engagement lever 66 is turned, the turning shaft 81 is turned via the coupling pin 79 and the lever 82, and a cloth feed pitch sensing signal corresponding to the quantity of rotation of the shaft 81 is output from the potentiometer 80.

It is to be noted that the lower-feed adjustment device includes the manually operated member 71, the feed adjustment member 61, the coupling rod 64, the engagement lever 66, the engagement rod 70 and the feed regulator 52.

(Upper-Feed Device)

Figure 4B:
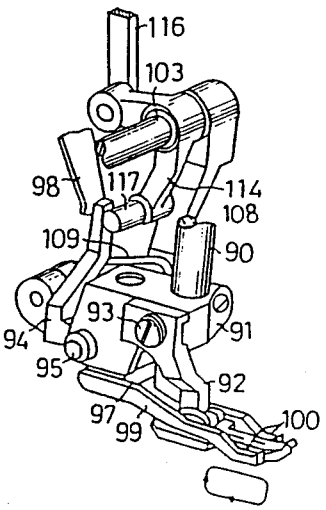
FIG. 4B is a partially enlarged perspective view of an upper-feed device.
Figure 4A:
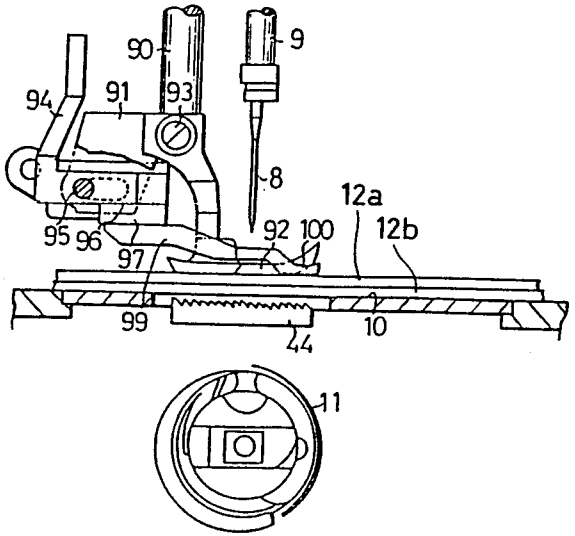
FIG. 4A is a side cross-sectional view showing a stitch forming device and a cloth pattern sensing means.

Now, an upper-feed device which applies a feed to the upper piece of cloth 12*a* by engaging the upper surface thereof will be described. As shown in FIGS. 4A and 4B, a pressure bar 90 is supported by the arm portion 2 of the machine frame 1 so that it can move vertically. It is also biased downward by a spring (not shown). An upper-feed base 91 having a substantially U-like cross-section is securely fixed to the lower end of the press rod 90. A presser foot 92 is attached by a screw 93 to the outer side of the pressure bar 90. When the pressure bar 90 is moved downwardly, a presser foot 92 presses the cloth pieces 12*a* against the cloth support surface 10.

A substantially L-shaped vertical-feed lever 94 is pivotably supported at its middle portion via a support shaft 95 to a backward portion of the upper-feed base 91, and a forward guide portion 96 of the lever 94 is disposed within the upper-feed base 91. The vertical-feed lever 94 is biased clockwise in FIGS. 4A and 4B by a leaf spring 98 engaged with the upper rear surface of the lever 94. Within the upper-feed base 91, a moving body 97 is supported at the guide portion 96 so as to move back and forth, and an upper-feed dog 99 is securely fixed at its rear end to the lower surface of the moving body 97. A teeth 100 is formed at the front end of the upper-feed dog 99 on each side of the presser foot 92. The upper-feed dog 99 is caused to perform a four-motion feed in accordance with a reciprocating turn of the vertical-feed lever 94 and a forward and backward movement of the moving body 97.

Now, the structure which applies a four-motion feed to the upper-feed dog 99 will be described. As shown in FIG. 3, a swing shaft 101 and an operating shaft 102 which extend parallel to the main shaft 4 are swingably supported within the arm portion 2 of the frame 1. A support shaft 103 is pivotably supported within the arm portion 2 between the swing shaft 101 and the upper-feed base 91. Swing levers 104 and 105 are attached to the left ends of the shafts 101 and 103, respectively, so as to swing therewith. A rectangular piece 106 provided on an upper end of the lower swing lever 105 is engaged with a bifurcate portion 107 formed at the lower end of the upper switch lever 104.

A swing arm 108 is securedly fixed at its upper end to the right end of the support shaft 103 so as to turn integrally therewith. The swing arm 108 also coupled at its lower end via a link 109 to the rear end of the moving body 97. On the other hand, an eccentric cam 110 for horizontal-feed is mounted at a middle portion of the main shaft 4. A crank rod 111 is mounted at its lower end to the eccentric cam 110 in an embracing manner. A coupling arm 112 is securely fixed to the swing shaft 101 opposed to the upper end of the crank rod 111, the lower end of the coupling arm 112 is pivotably coupled to the rear end of a link 113, and the upper end of the crank rod 111 is pivotably connected to a middle portion of the link 113.

The switch shaft 101 is caused to perform a reciprocating turn within a predetermined range via the crank rod 111, the link 113 and the coupling arm 112 by turning of the eccentric cam 110. This causes the moving body 97 to move back and forth via the swing levers 104, 105, the support shaft 103, the swing arm 108 and the link 109.

A two-arm-like lever 114 is pivotably supported at a middle portion of the support shaft 103. A coupling lever 116 is pivotably coupled at its upper end via a coupling arm 115 to the left end of the operating shaft 102. The lower end of the coupling lever 116 is pivotably coupled to a rear end of the lever 114. The lever 114 has at its lower end an engagement pin 117 which is engaged from backward with the uppwer end of the vertical-feed lever 94.

On the other hand, an eccentric cam 118 for vertical upper feed is mounted to the main shaft 4 in the vicinity of the horizontal-feed eccentric cam 110. A crank rod 119 is mounted at its lower end to the eccentric cam 118 in an embracing manner. The coupling arm 120 secured to the right end of the operating shaft 102 is pivotably coupled at its front end to the upper end of the crank rod 119. When the eccentric cam 118 is turned, the crank rod 119 is moved up and down within a predetermined range, so that the operating shaft 102 is caused to perform a reciprocating swing via the coupling arm 120. As a result, the lever 114 is caused to perform a reciprocating swing via the coupling arm 115 and the coupling lever 116. This movement is transmitted via the engagement pin 117 to the vertical-feed lever 94.

It is to be noted that the upper-feed device includes the eccentric cams 110, 118, the crank rods 111, 119, the switch shaft 101, the operating shaft 102, the vertical-feed lever 94, the moving body 97 and the upper-feed dog 99.

(Upper-feed Adjustment Device)

Figure 8:
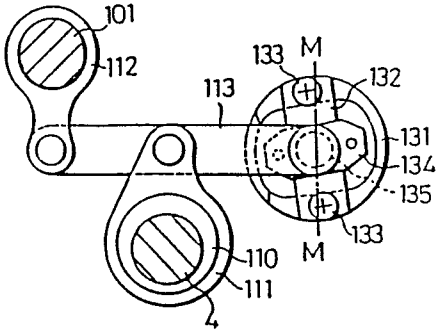
FIG. 8 is a partially enlarged side cross-sectional view of an upper-feed adjusting device.

Now, the upper-feed adjustment device which changes and sets the quantity and direction of cloth feed by the upperfeed dog 99 will be described. As shown in FIG. 3, a rotating shaft 130 extending parallel to the main shaft 4 is pivotably supported at a forward portion of the main shaft 4. A bottomed cylindrical feed regulator 131 is securely fixed at its bottom to the left end of the shaft 130. As shown in FIG. 8, a rectangular rod-like moving guide body 132 is fixed by a screw 133 to the edge of an opening in the feed regulator 131. A slider 134 is movably supported at the guide body 132. The link 113 is pivotably coupled at its outer end to a support pin 135 provided at the outer surface of the slider.

As shown in FIG. 8, the feed regulator 131 is normally disposed at a predetermined position. When the regulator 131 is rotated clockwise in FIG. 8 along with the rotating shaft 130 and as the angle between the center line of the moving guide body 132 and a reference line M—M decreases, the cloth feed pitch is reduced. On the other hand, when the regulator 131 is rotated counterclockwise in FIG. 8 and as the angle between the center line of the moving guide body 132 and the reference line M—M increases, the cloth feed pitch is increased.

As shown in FIGS. 6 and 7, a pulse motor 137 which has an output shaft 136 is provided at the arm portion 2 of the machine frame 1 in the vicinity of the right end of the turning shaft 130. A feed control lever 138 is mounted on the output shaft 136 of the pulse motor 137. An operating shaft 139 extending orthogonal to the operating shaft 130 is pivotably supported within the arm portion 2 so as to be positioned between the pulse motor 137 and the turning shaft 130. An engagement protrusion 140 protruding to the left direction is mounted on the outer forward periphery of the operating shaft 139 while a connecting lever 141 engageable with the feed control lever 138 through a link 142 is mounted on the outer backward periphery of the shaft 139.

A two-arm-like swingable lever 143 is securely fixed at its middle portion to the right end of the turning shaft 130 in the vicinity of the engagement protrusion 140 while a rear engagement portion 144 of the lever 143 is engaged from above with the engagement protrusion 140. On the other hand, in FIGS. 6 and 7, a coupling arm 145 is pivotably supported on an operating shaft 65 to the left of the operating lever 75. The front end of the coupling arm 145 is coupled by a coupling link 146 to the front end of the rotating lever 143. This coupling arm 145 is biased counterclockwise in FIG. 7 by a spring (not shown), and the swingable lever 143 is biased by the action of the spring via the engagement link 146 in the direction in which the swingable lever 143 is engaged with the engagement protrusion 140.

The coupling arm 145 has an engagement pin 147 at its right side which is disposed opposite to the lower surface of a front arm portion of the operating lever 75.

The feed control lever 138 is turned clockwise in FIG. 6 by the pulse motor 137 shown in FIG. 6. When the operating shaft 139 is turned clockwise in FIG. 6 by the engagement between the lever 138 and the connecting lever 141, the swingable lever 143 and the turning shaft 130 are turned clockwise in FIG. 7 by the action of a spring (not shown) which biases the coupling arm 145 so as to turn, so that the cloth feed pitch is reduced, as described above.

When the operated lever 77 is pressed down, as described above, the direction of cloth feed by the lower-feed device is reversed. Simultaneously, the feed regulator 131 are turned to a feed reversing position along with the turning shaft 130 via the operating shaft 65, the operating lever 75, the coupling arm 145, the coupling link 146 and the swingable lever 143 and thus the direction of cloth feed is reversed.

It should be noted that the upper-feed adjustment device includes the pulse motor 137, the feed control lever 138, the connecting lever 141, the operating shaft 139, the rotating shaft 130 and the feed regulator 131.

(Cloth Pattern Sensing Means)

Figure 2:
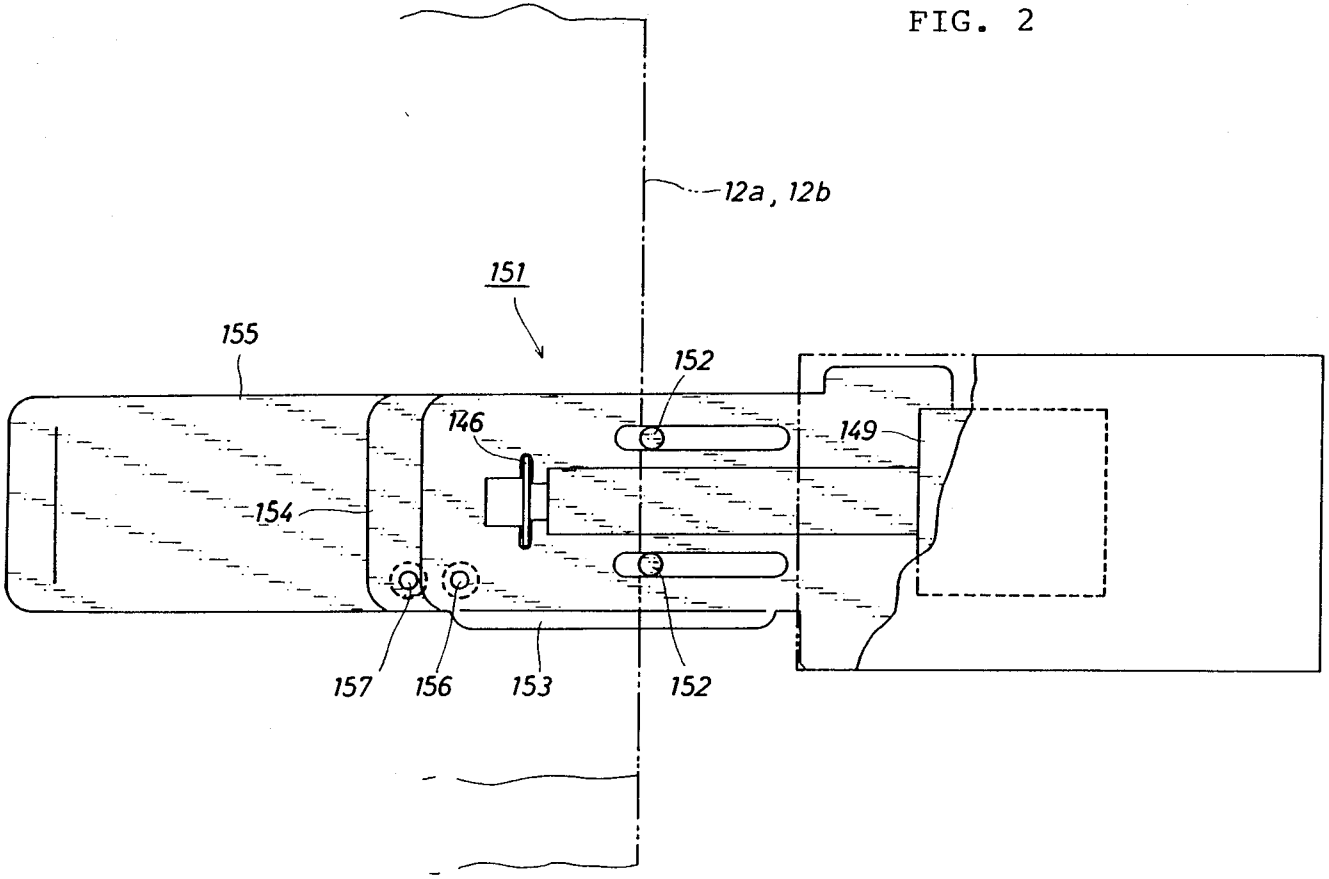
FIG. 2 is a plan view showing a cloth guide system.

As shown in FIGS. 1 and 2, a cloth guide system 151 is mounted on the cloth feeding side by the needle falling position of the bed portion 3. The cloth guide system 151 has a cloth end guide 152 and three metal separator panels 153, 154 and 155. The panels 153 through 155 are protrudedly attached on the left side of the cloth end guide 152 at certain spaces from one another. The lower surface of an edge of the upper panel 153 and that of the middle panel 154 respectively possess protrusions 156 and 157. An an edge of an upper cloth piece 12*a* is inserted between the plates 153 and 154 and the same of a lower cloth piece 12*b* between the plates 154 and 155, and then both the pieces 12*a* and 12*b* are fed in the following manner. The protrusions 156 and 157 give resistance on the cloth pieces 12*a* and 12*b* respectively. The resistance makes the cloth pieces 12*a* and 12*b* move towards the cloth guide system 152 to further feed the edges of the cloth pieces 12*a* and 12*b* along the cloth guide system 152 to the needle falling position.

Figures 9, 10:
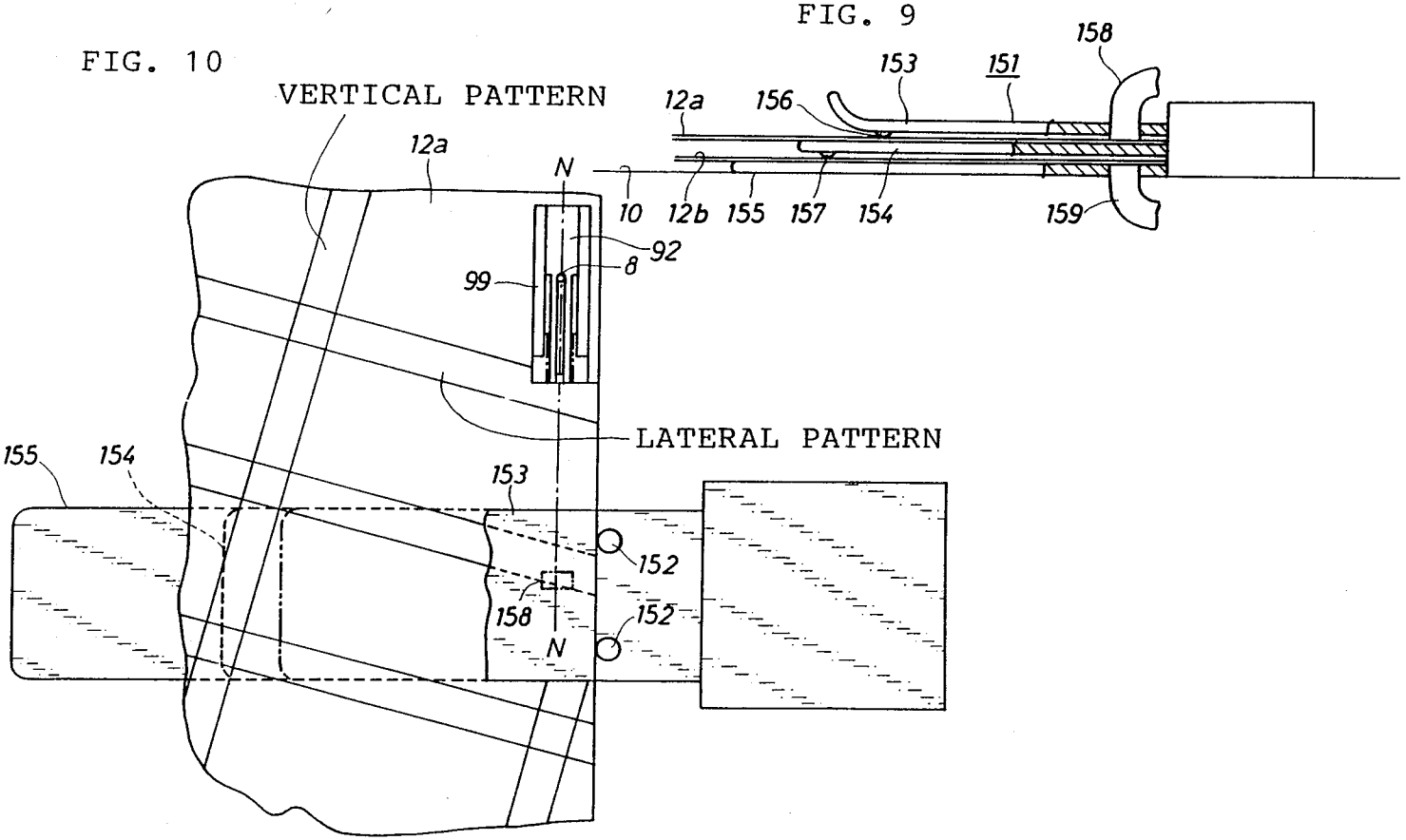
FIG. 9 is a partially-crossed front view of the cloth guide system of FIG. 2 in guiding position.
FIG. 10 is a plan view showing a part of the cloth guide system of FIG. 2.

Reflective-type sensors 158 and 159 as the cloth pattern detecting means irradiate the upper and lower cloth pieces 12*a* and 12*b* with detection light from signal light sources (not shown) including the sensors 158 and 159, respectively so as to optically detect the pattern of the cloth pieces 12*a* and 12*b*. The sensors 158 and 159 are supported, as shown in FIG. 10, through the upper and lower panels 153 and 155 to be positioned on a stitching line N passing through the needle falling position. The sensors 158 and 159 are further arranged on the upper surface of the upper cloth piece 12*a* and on the lower surface of the lower cloth piece 12*b* opposed to each other.

As shown in FIG. 1, on the front side of the arm portion 2 placed are a pattern matching key 175 for selecting a pattern matching mode and a pattern spacing key 176 for inputting a bit broader space than the maximum pattern spacing as a regular spacing so as to detect the displacement of the pattern. A display 177 shows the regular spacing inputted by the pattern spacing key 176. This regular spacing is stored in an aftermentioned RAM 168. The pattern spacing key 176 and the RAM 168 constitutes an interval setting means for setting a regular spacing desired. As shown in FIG. 2, an encoder 149 as an actual feed pitch detecting means for detecting the actual feed pitch of the upper cloth piece 12*a* is placed on the cloth guide system 151. The encoder 149 includes a rotator 148 which touches the upper cloth piece 12*a* and rotates. In sewing the cloth pieces 12*a* and 12*b*, the rotator 148 rotates in response to feeding of the upper cloth piece 12*a* and the encoder 149 outputs a cloth feeding amount detecting signal by every stitch corresponding to the rotation amount, that is, outputs a feed pitch detecting signal.

(Control Circuit)

Next, the machine control circuit in this embodiment will be described with reference to FIG. 11.

A central processing unit (CPU) 160 forms the differentiating means, the difference determining means and the feed pitch control means. It receives a start signal and a stop signal from a start and stop signal generator 162 in accordance with the operating of a foot pedal 161. The CPU 160 controls the driving of a machine motor 6 via a drive circuit 163. The CPU 160 receives a needle upper-position sensing signal, a needle lower-position sensing signal and a synchronous signal shown in FIG. 12 from the respective sensors 27–29, cloth feed pitch data from the potentiometer 80 and the actual feed pitch from the encoder 149.

The signals generated from the sensors 158 and 159 are A/D converted by an A/D converter 165 at every generation of the synchronous signal. The CPU 160 generates the intensity curves of the signals for each cloth pieces 12*a*, 12*b* and smoothes the curve. Then the CPU 160 differentiates the curves and matches the curves differentiated to determine the displacement amount and direction of the patterns on the upper and lower cloth pieces 12*a* and 12*b*.

Figure 12:
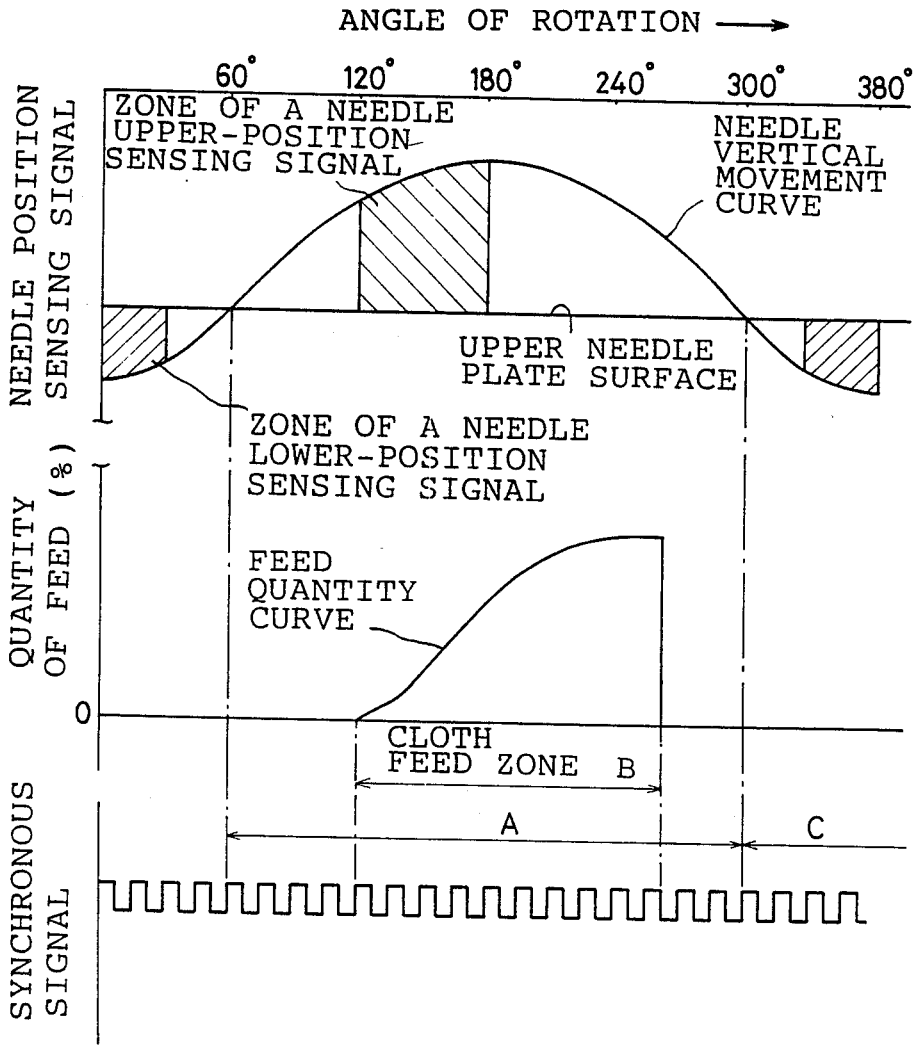
FIG. 12 is charts showing the needle position, the feed quantity and the synchronous signal each against the angle of rotation of the main axis of the sewing machine of the invention.

As shown in FIG. 11, a read only memory (ROM) 167 connected to the CPU 160, stores a program corresponding to the following flowcharts, various other programs for controlling the operation of the entire machine, and data on a cloth feed pitch corresponding to the synchronous signal as shown in FIG. 12.

In this embodiment, a period of time for feeding corresponds to the same for outputting the needle lower-position sensing signal and ten of the synchronous signals.

In response to the data of the displacement amount and direction, the CPU 160 drives the pulse motor 137 through a pulse motor driving circuit 169 to activate the feed regulator 131 so as to set the feed pitch of the upper cloth piece 12*a*.

Figure 13:
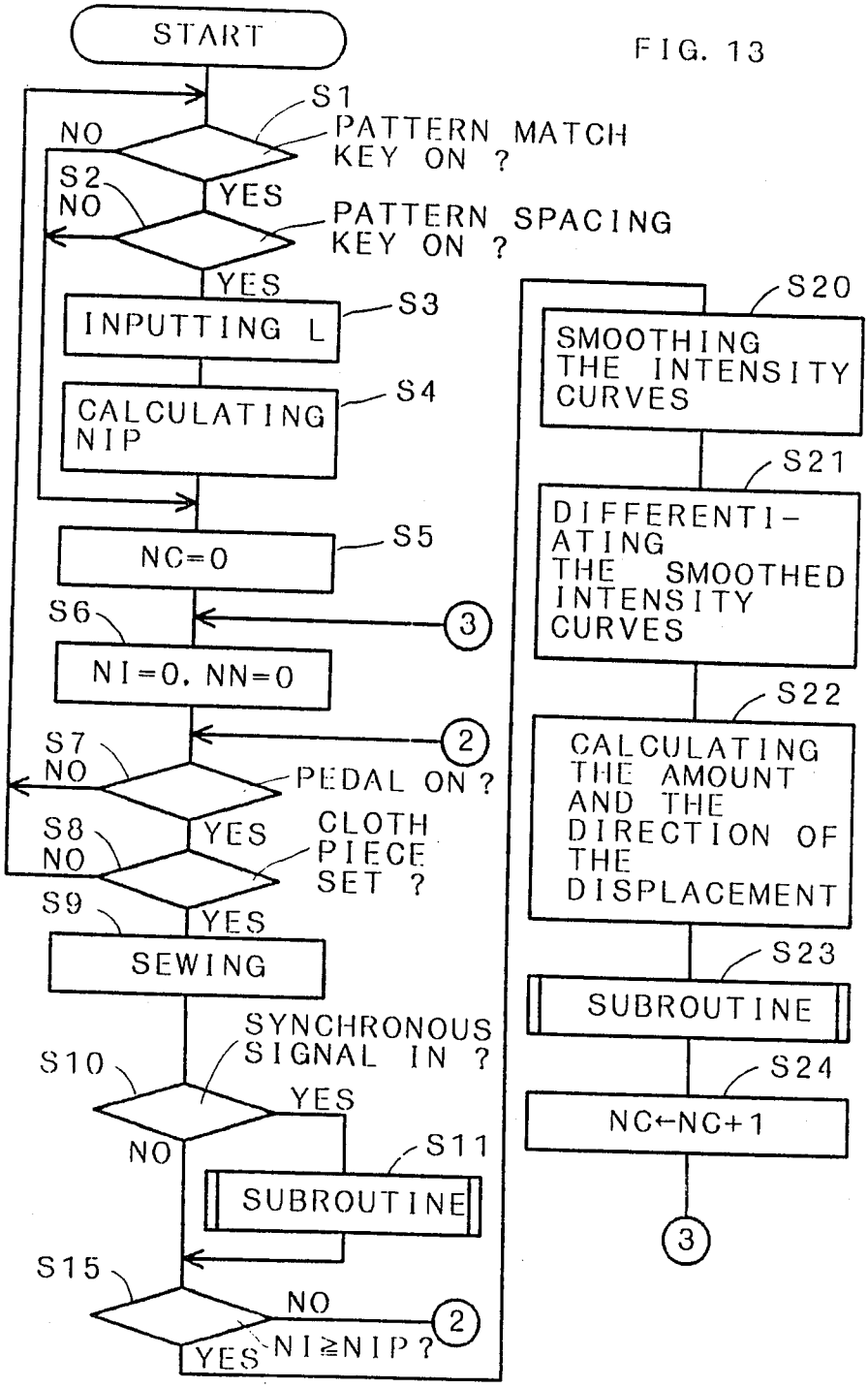
FIG. 13 is a flowchart showing a main routine of the program of the sewing machine.
Figure 14:
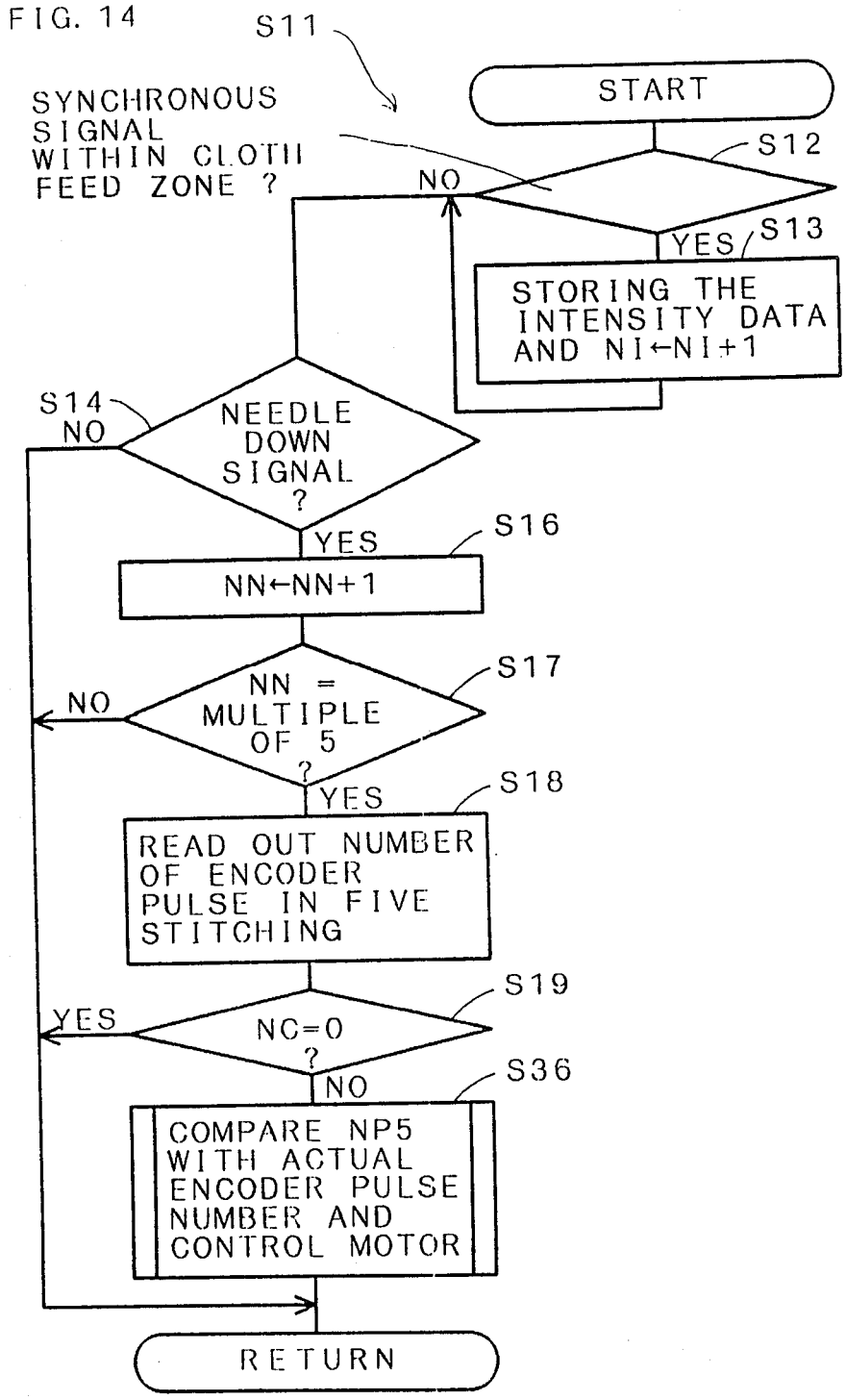
FIG. 14 is a flowchart showing the subroutine of step 11 of FIG. 13.

The operation of the sewing machine constructed as above is explained according to the flowcharts of FIGS. 13 through 15. These flowcharts proceed under the control of the CPU 160.

Figure 17A:
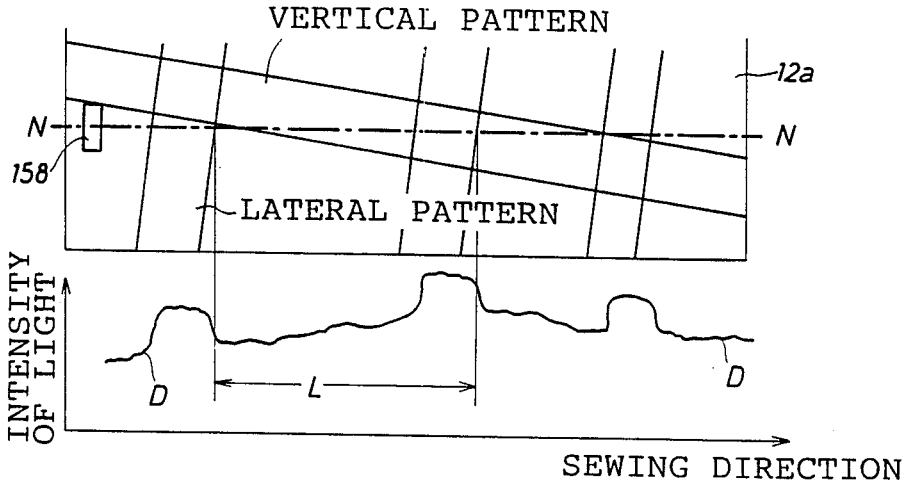
FIG. 17A is a chart showing a pattern of the upper cloth piece and its detected data.
Figure 17B:
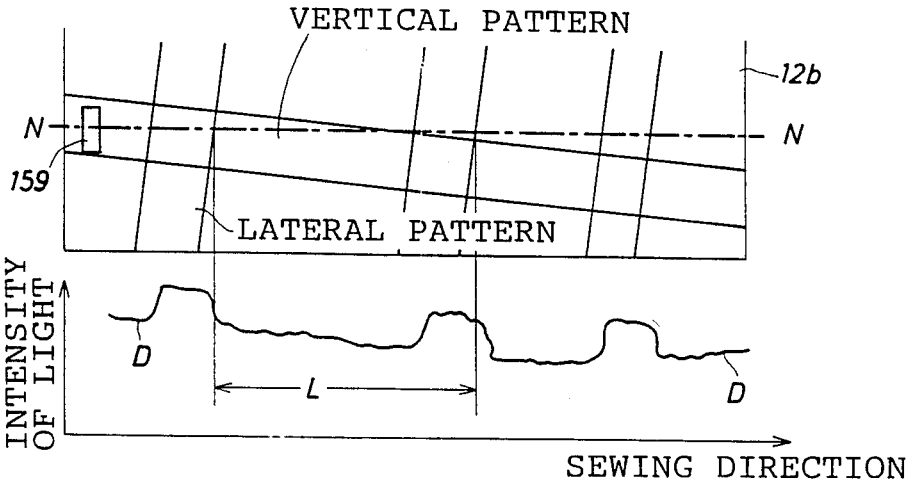
FIG. 17B is a chart showing a pattern of the lower cloth piece and its detected data.

An operator first, as shown in FIGS. 9 and 10, inserts the cloth pieces 12*a* and 12*b* with the same pattern through the cloth guide system 151 to set them on the cloth support surface 10. The presser foot 92 is lowered to press the cloth pieces 12*a* and 12*b* on the cloth support surface 10. In the meantime, the pattern matching mode is set by the pattern matching key 175, and a pattern spacing a bit longer than the maximum spacing of the lateral patterns adjacent to each other is set as a regular spacing L, as shown in FIGS. 17A and 17B, by the pattern spacing key 176. Then the foot pedal 161 is stepped down to start sewing. While sewing, the displacement amount of the pattern between the upper and lower cloth pieces 12*a* and 12*b* are detected every time after the sewing of the regular spacing L has been accomplished. Corresponding to the displacement amount, the pulse motor 137 is rotated to adjust the feed pitch of the upper cloth piece 12*a*.

The processing steps are explained in detail according to the flowcharts of FIGS. 13 through 15. When the pattern matching mode is set through the operation of the pattern matching key 175 and the regular spacing L is inputted by the pattern spacing key 176, the determination at both steps S1 and S2 is "YES" and the spacing L is stored into the RAM 168 at step S3. At step S4, the normal number of data corresponding to the length L is computed. First, the length L is divided by the length of the feeding pitch of the lower cloth piece 12*b* and is then multiplied by the number of the synchronous signals (10 in this embodiment as shown in FIG. 12) detected while feeding every stitch in the cloth feed zone B. For example, when the spacing L is 30 mm and the feeding pitch is equal to 3 mm, $30/3\times10=100$ is computed and the value 100 is stored into the RAM 168 as the regular number NIP of the intensity data. At step S5, the number NC of control indicating the number of regulating the pulse motor 137 for correcting the displacement is initialized to zero and is stored into the RAM 168. At step S6, the number NI of the intensity of light and the number NN of stitching both mentioned below are initialized and are stored into the RAM 168.

At step S7, it is determined if the pedal 161 is stepped down and if the answer is NO, the program returns to step S1. The processing at both steps S3 and S4 are conducted only when the pattern matching key 175 and the pattern spacing key 176 are operated, and the processed data are retained until the re-operation of the keys or the power is turned off.

If the peal 161 is on or stepped down, sensors 158 and 159 judge if upper and lower cloth pieces 12*a* and 12*b* are set on the cloth guide system 151 at step S8. If they are set, the program proceeds to step S9 where sewing starts by the rotation of the motor 6. At this time, accompanied by feeding of the cloth pieces 12*a* and 12*b*, the rotator 148 engages with the upper cloth piece 12*a* to rotate and then the pulse signal is generated from the encoder 149. The counting data is stored into the RAM 168. At the following step S10, it is determined if a synchronous signal is inputted from the synchronous signal detector 29 and if the answer is YES, the program proceeds the subroutine of step S11 shown in FIG. 14.

Figure 16:
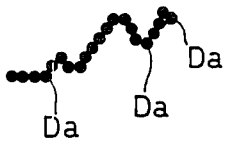
FIG. 16 is an enlarged view showing data of the light intensity.

In this subroutine, at step S12, it is determined if symchronous signal is within the cloth feed zone B of FIG. 12. Namely, step S12 judges if the cloth pieces are being fed. If the answer is NO, the program proceeds to step S14 to return to the main routine of FIG. 13, and if the answer is YES, the program proceeds to steps 13 and 14 to return to the main routine of FIG. 13. At step S13, the quantity of reflected light of the upper and lower cloth pieces 12*a* and 12*b* detected by the sensors 158 and 159 is A/D converted by the A/D converter 165. The data converted is stored into the RAM 168 as each of the light intensity data Da and then the number of light intensity data is incremented by one. At step S14, it is determined if the needle down signal is generated and if the answer is NO, the program returns to the main routine of FIG. 13. This determination is performed by judging if the needle position sensing signal of FIG. 12 moved from zone A to zone C. Every time when the synchronous signal is outputted corresponding to feeding, the light intensity data Da of the cloth pieces 12*a* and 12*b* shown in FIG. 16 is stored into the RAM 168 one by one and is successively accumulated as the detected data D shown in FIGS. 17A and 17B. At step S15 of FIG. 13, it is judged if the number NI of the light intensity data Da attains the regular number NIP=100, and if the answer is NO, the program returns to step S7. When the output of the needle down signal is confirmed at step S14 of FIG. 14, the program proceeds to step S16 where the stitch data NN is incremented by one and is stored into the RAM 168. At step S17, it is determined if the stitch data NN stored into the RAM is a multiple of 5, and if the answer is NO, the program returns to the main routine of FIG. 13. The processing from step S7 through step S17 is repeatedly executed until the stitch data NN attains a multiple of 5.

When the stitch data NN becomes a multiple of 5, the program proceeds to step S18 where the number of the upper cloth piece encoder pulses detected from the encoder 149 in sewing five stitches is read out from the RAM 168. At step S19, the number NC of the control is judged if being equal to zero, and if the answer is YES, the program returns to the main routine of FIG. 13. If the answer is NO, the program proceeds to step S36 of FIG. 14. In the first stage of this processing, the judgment of step S19 is YES, and the program proceeds to step S15 of FIG. 13.

Figure 18:
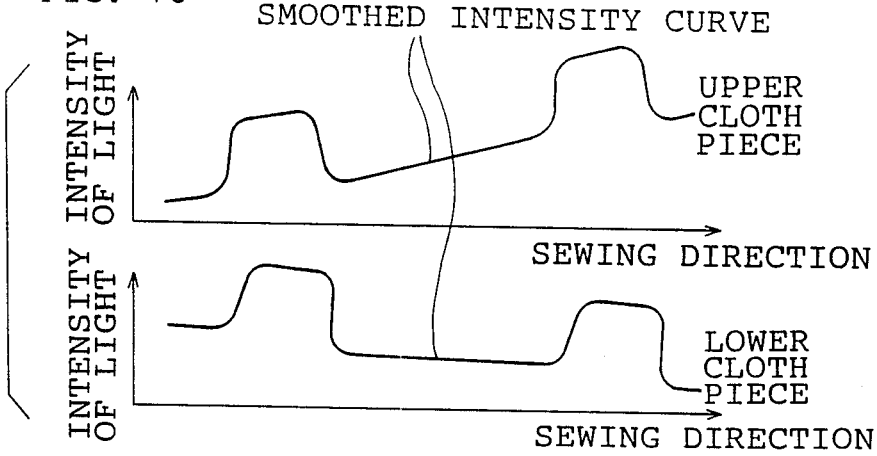
FIG. 18 illustrates graphs showing the respective curve for each cloth piece after smoothing.
Figure 19:
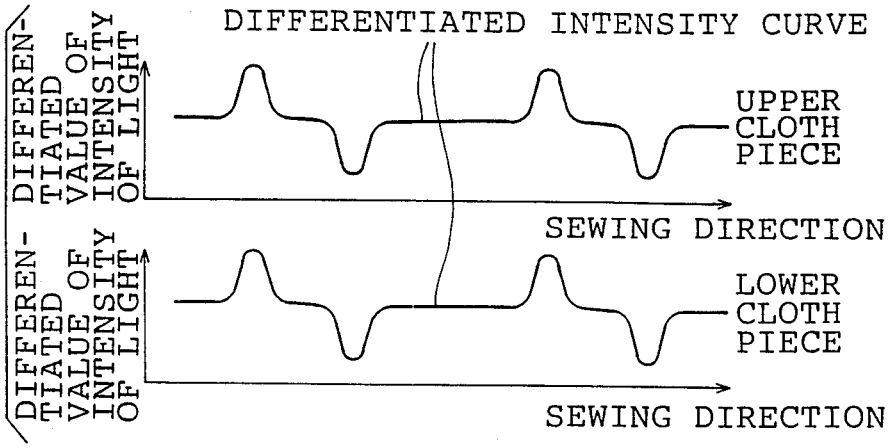
FIG. 19 illustrates graphs showing the differentiated intensity curve for each cloth piece.

At step S15, when the number NI of light intensity data Da is confirmed to attain the regular number NIP=100, that is, when the sewing of the regular spacing L has been accomplished, the program proceeds to step S20 where the intensity curves for pattern detecting data D of the upper and lower cloth pieces 12*a* and 12*b* is smoothed as shown in FIG. 18. At step S21, the light intensity curve of the above smoothed data is differentiated to eliminate the noise as well as to cut off and neglect the data corresponding to the vertical pattern passing over the sensors 158 and 159 slowly. Thus, the data curve differentiated at step S21 has peaks only corresponding to the edge of the lateral pattern as shown in FIG. 19.

Figure 20:
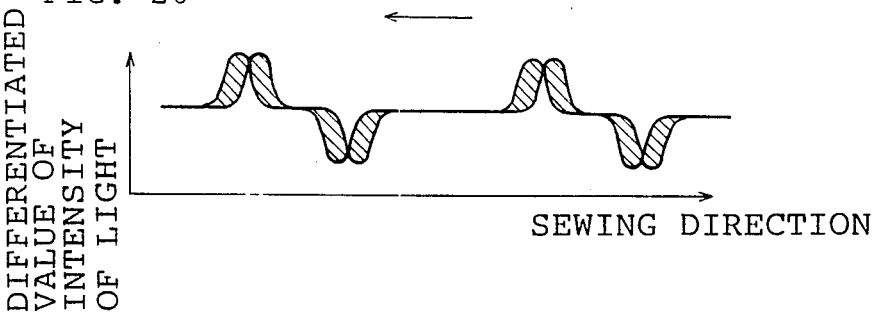
FIG. 20 is a graph showing the matching condition of the curves in FIG. 19.

At step S22, the differentiated curves corresponding to the lateral patterns of the upper and lower cloth pieces 12*a* and 12*b* are compared with each other to calculate the difference between the upper and lower data. Namely, the amount and direction of the displacement between the patterns of the cloth pieces 12*a* and 12*b* are computed. First, as shown in FIG. 20, one of the differentiated curves is shifted by one of the intensity data in the direction of the arrow or in the opposed direction to find the position at which the difference between the two curves is minimum. Then, the same process is executed for the other differentiated curve to find the optimum position. From these results, the amount of the displacement Ma of the lateral patterns and the displacement direction against the sewing direction are calculated.

Figure 21:
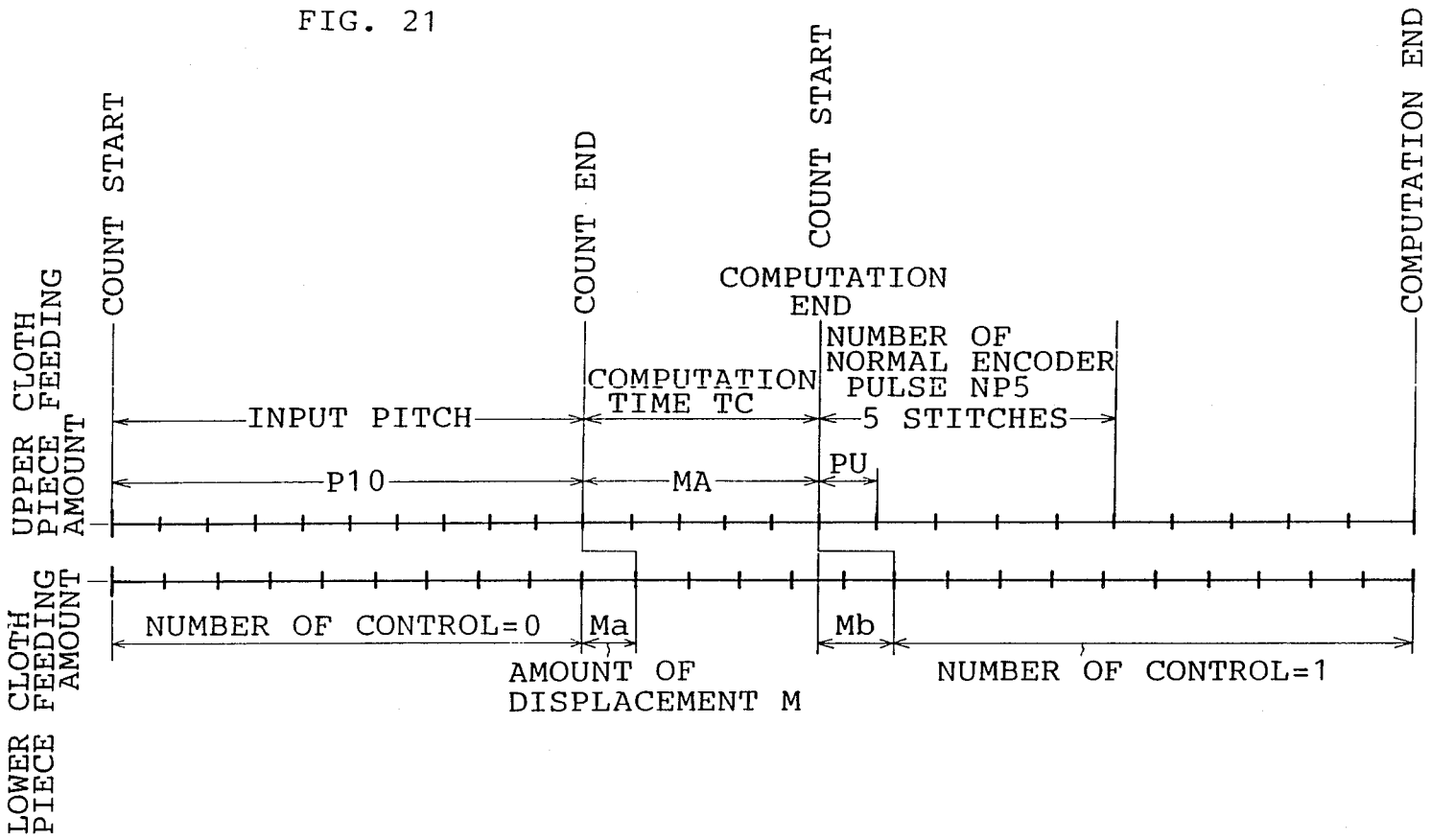
FIG. 21 is a chart showing the process for correcting the displacement of the pattern.
Figure 22:
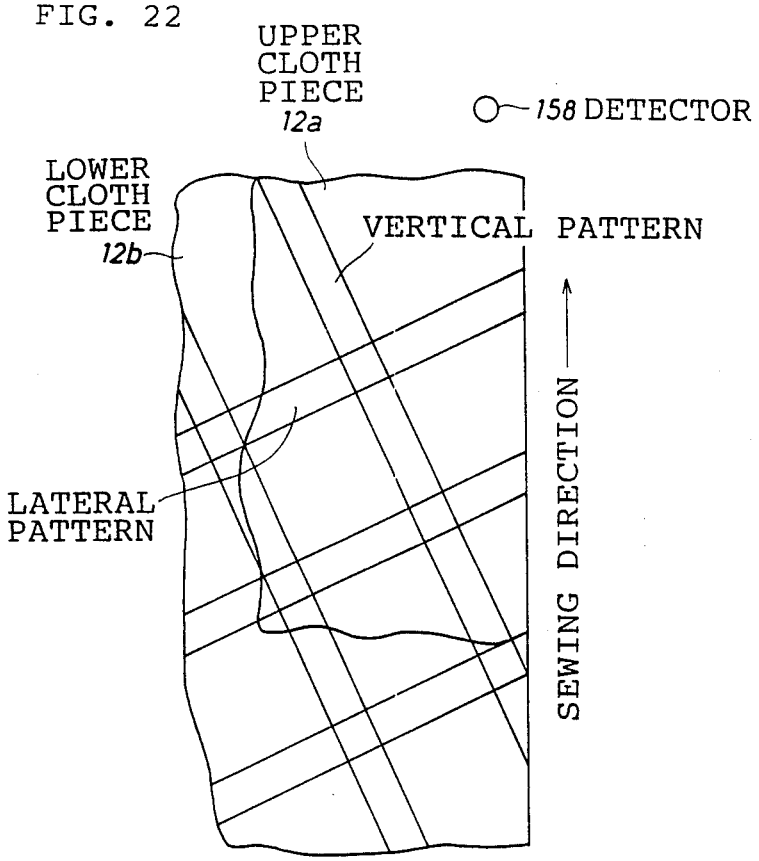
FIG. 22 is a plan view showing the sewing method for the pattern matching.
Figure 23A:
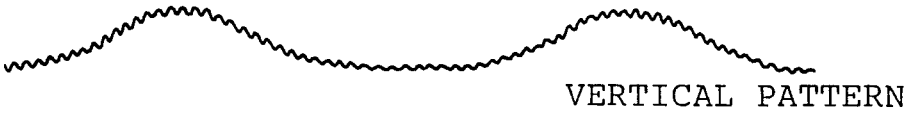
FIGS. 23A and 23B are charts showing the pattern data detected by a conventional sewing machine.
Figure 23B:
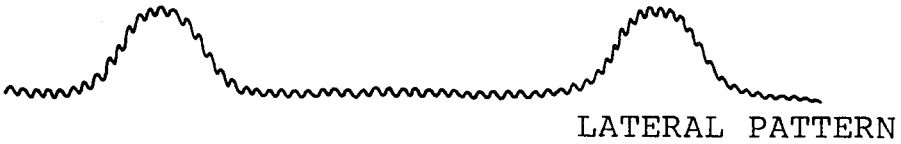

The program then proceeds to the subroutine of step S23, which is shown in FIG. 15 and the operation is shown in FIG. 21. At step S24 of FIG. 15, computed is the feeding amount MA of the upper cloth piece 12*a* for the time period TC, which is required for calculating the displacement of patterns at steps S20 through S22. And computed is the total amount of displacement Mb by assumption from the feeding amount MA and the amount of displacement Ma (in FIG. 21). The program then proceeds to step S25 where it is determined if the total amount of displacement Mb is less than the predetermined normal value of the displacement amount. If the answer is YES, since the correction is unnecessary, the program proceeds to step S35 where the rotative position of the pulse motor 137 is initialized in order to dispose the feed regulator 131 at the predetermined position, and then proceeds to step S32 where the pulse motor starts rotating to initialize the feed pitch of the upper feeding teeth 100. On the other hand, if Mb is more than the predetermined normal displacement amount, the program proceeds to step S26 where the number NC of regulating the pulse motor 137 is compared with zero. If the answer is NO, the program proceeds to step S27 and if the answer is YES, it goes to step S28.

At step S27, it is determined if the sign of the displacement amount of the previous control and that of the current control are the same. Namely, it is judged if the negative or positive sign of the displacement amount is inverted. When the displacement is corrected and the sign is inverted, the program proceeds to step S35 to step S32 where the feed pitch of the upper feeding teeth 100 is initialized. On the other hand, if the sign is not inverted, the program proceeds to step S28 where the normal number NP5 of the encoder pulse corresponding to next five stitches after the end of the computation of the displacement amount is calculated to be stored into the RAM 168. For this calculation, the total encoder pulse number P10, which is detected by the encoder 149 as the feeding amount of the upper cloth piece while sewing of the regular spacing L (in this embodiment, 10 stitches) is being conducted, the displacement amount Mb and the sign of Mb showing the displacement direction are used. Accordingly, the feeding amount of the upper cloth piece at every five stitches is set as the normal encoder pulse number NP5 of the encoder 149 so as to correct the pattern displacement after sewing of the next regular spacing L (see FIG. 21). At step S29, based on the computed result of step S28, the rotation amount of the pulse motor 137 is calculated so as to realize the upper feeding pitch PU corresponding to the normal encoder pulse number NP5. Then the program proceeds to steps S30 and S31 where the calculated rotation amount of the pulse motor 137 is compared with a predetermined range. If the calculated amount is within the predetermined range, the pulse motor 137 starts rotating in response to that amount at step S32. But, if the amount is judged to be out of the range at step S30 or at step S31, the program proceeds to step S33 or step S34 where the value of the rotation amount is set at the upper limit or lower limit of the predetermined range. As a result, it can prevent the upper cloth piece from feeding too much or to too little so as not to cause puckering or too much elongation.

Then the program proceeds to step S37 of the main routine shown in FIG. 13 where the control number NC is incremented by one, and then returns to step S6. After the intensity data NI and the stitching number data NN are initialized at step S6, the processing beginning with step S7 is repeatedly executed. Since the control number NC has been already incremented by one at step S37, this time the result of determination at step S19 is NO and the program proceeds to step S36. At step S36, the normal encoder pulse number NP5 showing the corrected feed pitch, which is set at step S28, is compared with the actual encoder pulse number detected at step S18. If the values are different from each other, the pulse motor 137 rotates corresponding to the difference and the sign. For example, when the detected pulse number is more than NP5, the pulse motor 137 is controlled to have a pitch calculated by subtracting a value from the actual feed pitch. The value is computed first by multiplying the difference by a correction factor and then by dividing it by 5. In the manner mentioned above, ever time when the sewing of five stitches has been accomplished, the actual feeding pitch of the upper cloth piece 12*a* is corrected to be consistent with the feeding pitch PU. After the sewing of the regular spacing L has been accomplished, the pattern displacement between the upper and lower cloth pieces 12*a* and 12*b* is detected. If the displacement is more than the normal amount at step S25, the above correction process beginning with step S26 is executed.

As described above in the sewing machine of this invention, first, the light intensity curves are computed based on the detected pattern data of the upper and lower cloth pieces 12*a* and 12*b*. second, the curves are compared with each other to compute the displacement amount of the patterns of the upper and lower cloth pieces 12*a* and 12*b*. In other words, when the cloth pieces 12*a* and 12*b* have the vertical patterns, the detected data of the vertical pattern is neglected, and the displacement amount is accurately detected only based on the data corresponding to the lateral pattern. Thus, the correction of displacement is adequately executed in response to the displacement amount and two cloth pieces 12*a* and 12*b* are sewn with the patterns matching thereon.

Although the invention has been described with reference to a specific embodiment thereof, it will be apparent that numerous changes and modifications may be made therein without departing from the scope of the invention. For example, a lower feeding system may be activated to correct the displacement or both the upper and lower feeding systems may be activated. A sensor of the transmittable light detection type may be used as the detection means. Line-sensors which have a plural of detection portion respectively may be set along the stitching line N as the close pattern detecting means. The line-sensors may be able to detect the patterns for each cloth pieces 12*a*, 12*b* when the cloth pieces 12*a*, 12*b* are stopped on the cloth support surface 10. A separator plate is set between the teeth 100 and the lower-feed dog 44. The separator plate may be able to separate the cloth pieces 12*a*, 12*b* and to neglect the influence of the lower-feed adjustment device on the feed pitch of the upper cloth piece 12*a* and the opposite influence.

What is claimed is:

1. A sewing machine, comprising:

stitch forming means including a needle movable up and down through a cloth support surface for sewing two overlapped cloth pieces, said two cloth pieces having a same pattern;

upper feeding means arranged over said cloth support surface for feeding the upper one of the two cloth pieces, said upper feeding means being actuated synchronously with said stitch forming means;

lower feeding means arranged under said cloth support surface for feeding the lower one of the two cloth pieces, said lower feeding means being actuated synchronously with said stitch forming means;

first sensor means for detecting intensity of light reflected or transmitted from the upper cloth piece and for generating intensity signals;

second sensor means for detecting intensity of light reflected or transmitted from the lower cloth piece and for generating intensity signals;

memory means for storing the intensity signals generated by said first and second sensor means;

intensity curves generating means for generating first and second intensity curves extending over a predetermined distance for each of the cloth pieces based on the intensity signals in said memory means, said first intensity curve corresponding to the upper cloth piece and said second intensity curve corresponding the lower cloth piece;

differentiating means for differentiating the first and second intensity curves and for generating a first differential curve corresponding to the upper cloth piece and a second differential curve corresponding to a lower cloth piece;

difference determining means for determining displacement between the first and second differential curves; and feed pitch control means for adjusting a feed pitch of at least one of said upper and lower feeding means in order to align the patterns of said cloth pieces (12*a*, 12*b*) based on the displacement.

2. A sewing machine according to claim 1, wherein each said first and second sensor means comprises a sensor, the sensor of said first sensor means is arranged at the upper side of said cloth support surface and detects the intensity of light from said upper cloth piece and the sensor of said second sensor means is arranged at the lower side of said cloth support surface and detects the intensity of light from said lower cloth piece.

3. A sewing machine according to claim 1, wherein the sewing machine further comprises interval setting means for setting the predetermined distance.

4. A sewing machine according to claim 1, wherein said differentiating means includes smoothing means for smoothing said first and second intensity curves by cutting off small roughnesses on the curves before differentiating the first and second intensity curves.

5. A sewing machine according to claim 1, wherein said difference determining means determines the amount and the direction of the displacement of the patterns on said two cloth pieces.

6. A sewing machine according to claim 4, wherein said difference determining means determines the amount and the direction of the displacement of the patterns on said two cloth pieces.

7. A sewing machine according to claim 1, wherein said feed pitch control means adjusts the feed pitch of at least one of said upper and lower feeding means when the amount of the displacement is greater than a predetermined value.

8. A sewing machine according to claim 1 wherein said feed pitch control means adjusts the feed pitch of at least one of said upper and lower feeding means to predetermined feed pitch when the amount of the displacement is less than a predetermined value.

9. A sewing machine according as to claim 1, wherein said feed pitch control means aligns the patterns on said two cloth pieces within a predetermined time interval.

10. A sewing machine according to claim 3, wherein said feed pitch control means aligns the patterns on said two cloth pieces within the predetermined distance set by said interval setting means.

11. A sewing machine according to claim 1, wherein the sewing machine further comprises correction means for comparing an actual feed pitch with an adjusting feed pitch determined by the feed pitch control means and for correcting the present feed pitch to follow the adjusting feed pitch.

* * * * *